United States Patent [19]

Hsiao

[11] Patent Number: 4,956,756

[45] Date of Patent: Sep. 11, 1990

[54] TABLE LAMP ADAPTER SYSTEM

[76] Inventor: Wen J. Hsiao, No. 20, Lane 126, Jen AI Street, Hsin Chu City, Taiwan

[21] Appl. No.: 308,604

[22] Filed: Feb. 10, 1989

[51] Int. Cl.[5] ..... H01R 33/00

[52] U.S. Cl. ..... 362/226; 362/229; 362/251; 362/254; 362/457

[58] Field of Search ..... 362/95, 226, 229, 251, 362/254, 457

[56] References Cited

U.S. PATENT DOCUMENTS

| | | | |
|---|---|---|---|
| 3,446,954 | 5/1969 | Spiteri | 362/226 |
| 3,815,080 | 6/1974 | Summa | 362/95 |
| 3,900,725 | 8/1975 | Komon | 362/226 |
| 4,450,510 | 5/1984 | Nilssen | 362/254 |
| 4,525,773 | 6/1985 | Hesse et al. | 362/226 |

*Primary Examiner*—Ira S. Lazarus
*Assistant Examiner*—Sue Hagarman
*Attorney, Agent, or Firm*—Morton J. Rosenberg; David I. Klein

[57] ABSTRACT

The present invention provides a table lamp adapter system for providing interchangeability between incandescent and fluorescent light bulbs. There is provided a table lamp system which includes a detachable lamp holder tubular housing 1 in combination with selector switch mechanism 2 and a three-step power switch 5 wherein the lighting source, whether it be fluorescent lamps or incandescent lamps, of the table lamp, is changeable to meet the user's wishes. Additionally, a support arm 7 is detachable from the overall system for separate storage to minimize space consumption.

2 Claims, 6 Drawing Sheets

TABLE LAMP ADAPTER SYSTEM

BACKGROUND OF THE INVENTION

1. Field of the Invention

The instant invention concept is related to a table lamp adapter system which allows for interchangeability between incandescent and fluorescent light bulb systems. More particularly, this invention relates to a lamp holder connector for use on arm lamp or lamp stand types to allow the lighting source to be replaceable between fluorescent and incandescent light bulbs. Still further, this invention directs itself to a table lamp and desk adapter system having a lamp holder tubular housing within which is inserted a selector switch for reversibly switching from incandescent to fluorescent light bulb systems.

2. Prior Art

Table lamps are common illuminators which are commercially used throughout the World. Generally, table lamps of the prior art type systems are equipped with fluorescent lamp tubes or incandescent light bulbs as a lighting source. In some cases, persons may prefer to have a fluorescent tube type lamp, while other may wish an incandescent light bulb type table lamp.

Prior art systems where one wishes to change the lighting source to match with a particular environmental requirement, the person may have had to change the entire table lamp including the lamp holder and a support arm. Consequently, such prior art systems were economically not feasible, in that persons wishing to change from one type of light bulb to another had to purchase two different types of table lamps. Additionally, such prior art systems required more space on a table if two totally different types of lamps were to be used. Still further, if two different types of lamps were necessitated, storage of at least one of them was necessitated and became inconvenient. Prior art systems were more complicated when the lighting source had to be changed in that many parts had to be removed to detach the entire lamp holder for replacement of another lighting device of a different lighting source.

SUMMARY OF THE INVENTION

A table lamp adapter system for providing interchangeability between incandescent and fluorescent light bulbs which includes a lamp holder tubular housing having a front section coupled to the light bulb and a rear section having a stub member protruding therefrom. There is included a selector switch mechanism for switching reversibly from incandescent to fluorescent light bulb power actuation with the selector switch mechanism including a contact plug member received within the lamp holder tubular housing. A sleeve member having a guide slot formed therein is provided where the stub member is linearly displaceable within the guide slot. A spiral coupling having internal threads and rotatable responsive to the linear displacement of the stub within the guide slot is included with the spiral coupling being mounted on the sleeve member on a frontal portion thereof in a manner such that through alignment of the internal threads of the spiral coupling with the guide slot, the stub member is displaced within the guide slot. A support arm member is fixedly coupled to a rear portion of the sleeve member. The selector switch mechanism further includes a conduction member having four terminals arranged in two sets. The conduction member is mounted in the sleeve member and further includes a front end surface member having four recess holes and a rear end surface member which includes four mandrels for mounting thereon of four springs respectively, wherein two pairs of terminals are respectively mounted on the springs. The springs are in alignment with the mandrels and the recess holes of the front end of the surface member. The terminals are resiliently mounted therein whereby a pair of contact noses of the contact type plug may be selectively in contact with the pairs of the terminals of the conduction member.

An object of the subject invention is to provide a lighting source of the table lamp which is changeable between an incandescent light bulb setting and a fluorescent light bulb setting. Additionally, it is an object of the subject invention to provide a structure for a table lamp which is practical for ease of assembly and detachment.

Thus, the main object of the present invention is to provide a table lamp which includes a lamp holder for efficiently alternative replacement of a lamp tube or a lamp bulb.

Another object of the subject invention is to provide a table lamp which includes a selector switch, a three step power switch, and two separate power cords such that the table lamp is applicable for connection thereto of fluorescent lamps or incandescent lamp bulbs.

A still further object of the present invention is to provide a table lamp where the lamp holder and the support arm are detachable to facilitate the changing of the lighting source.

Other objects, features and advantages of the present invention will be apparent from the following description based upon the annexed drawings as provided in following paragraphs.

DESCRIPTION OF THE PREFERRED EMBODIMENTS

Referring now to FIGS. 1–6, there is shown a table lamp adapter system which includes lamp holder tubular housing 1 having front section 11 coupled to a light bulb and rear section 12 having stub 121 protruding externally therefrom.

Figure 2:
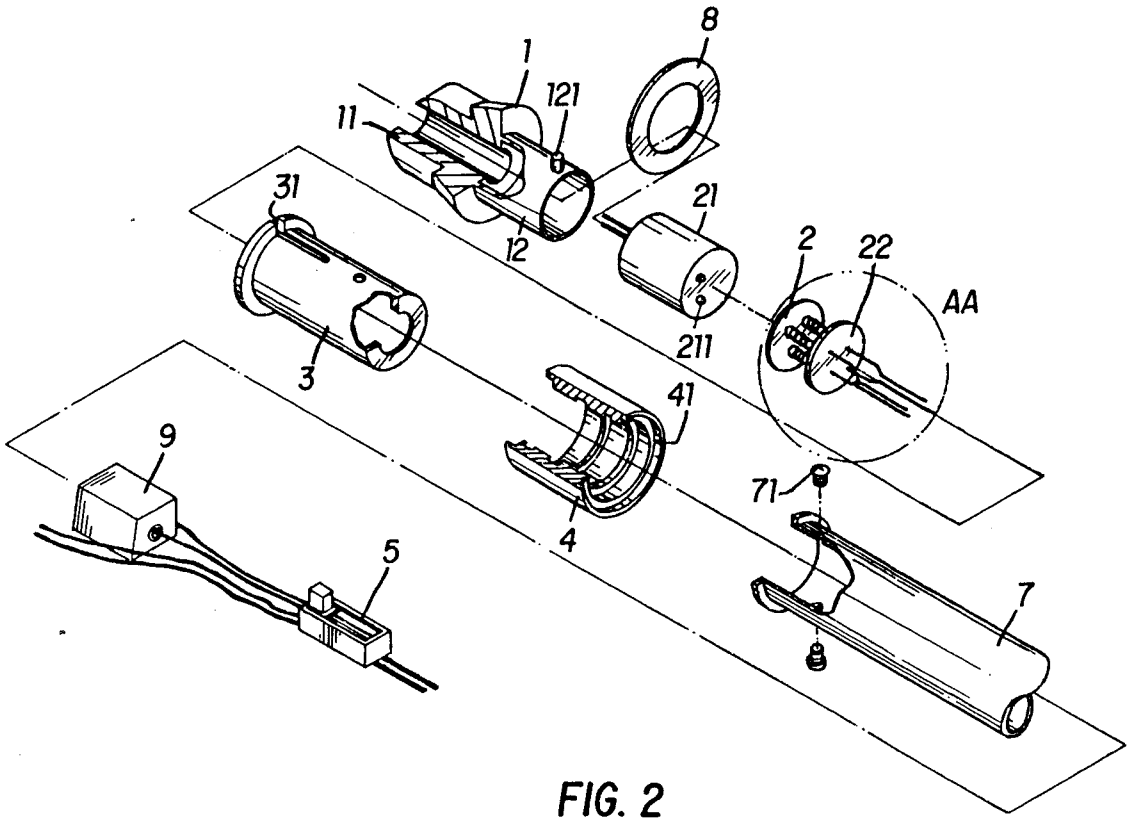
FIG. 2 is a perspective exploded view of the elements comprising the table lamp adapter system of the subject invention.

In overall concept, there is provided sleeve 3 having a guide slot 31 formed therein as shown in FIG. 2 with a spiral coupling 4. A three step switch 5 is coupled to transformer 9 and to standard outlet power cords 6.

Figure 1:
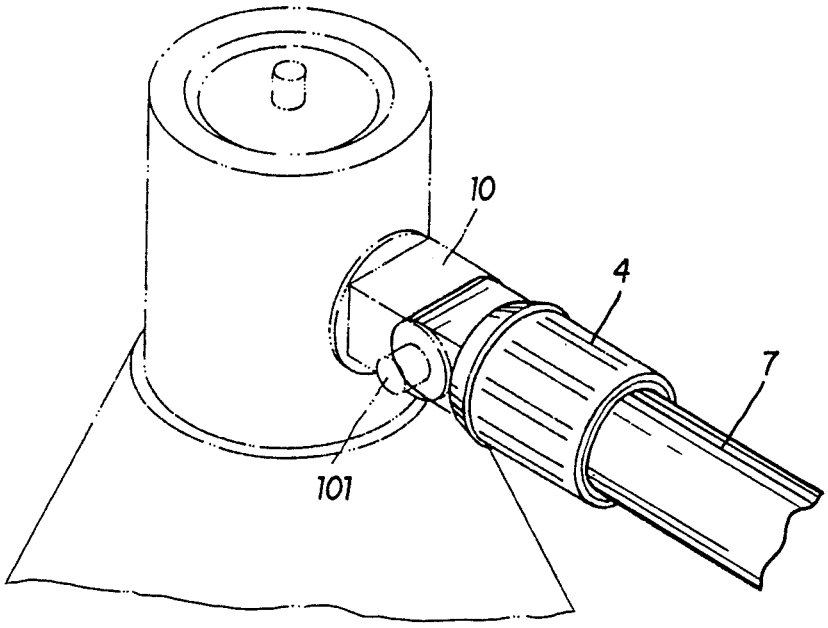
FIG. 1 is a perspective view of the outer surface of the subject table lamp adapter system.

Referring to FIG. 1, there is provided universal joint 10 having a revolving knob 101 to control up/down and left/right angular adjustment of the illumination of the lamp such that connection of lamp holder tubular housing 1 and sleeve member 3 is contained therein and protected from the external environment in order to increase the service life of the subject table lamp adapter system.

Lamp holder tubular housing 1 has a hollow tubular configuration including an internal space for receiving contact type plug 21 of selector switch mechanism 2, as shown in FIG. 2. Lamp holder tubular housing 1 includes front end 11 which is arranged for connection thereto of lamp bulb A or lamp bulb B and housing 1 has a rear section 12 which includes stub member 121 extending external from the outer circular surface.

Spiral coupling member 4 has a hollow tubular configuration and an inner thread 41 and is mounted on sleeve 3 at a frontal portion thereof. Through a matching or alignment of inner thread 41 with guide slot 31, stub member 121 is linearly displaced along guide slot 31 and inner thread 41. Conduction member 22 of selector switch mechanism 2 is located within sleeve member 3 and sleeve member 3 is fixedly attached to support arm 7 by means of screws 71 formed at a back portion thereof.

Figure 5A:
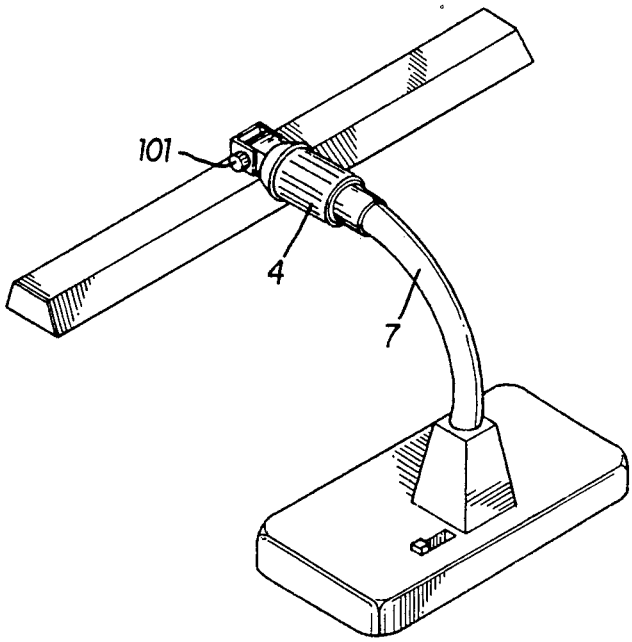
FIG. 5 is a schematic drawing of a table lamp constructed according to the present invention concept; and, FIG. 6 is a schematic drawing of still another table lamp constructed according to the present invention concept.
Figure 5B:
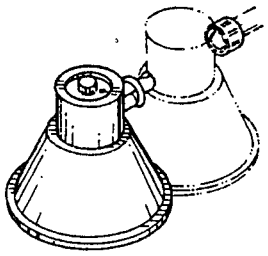
Figures 6A, 6B:
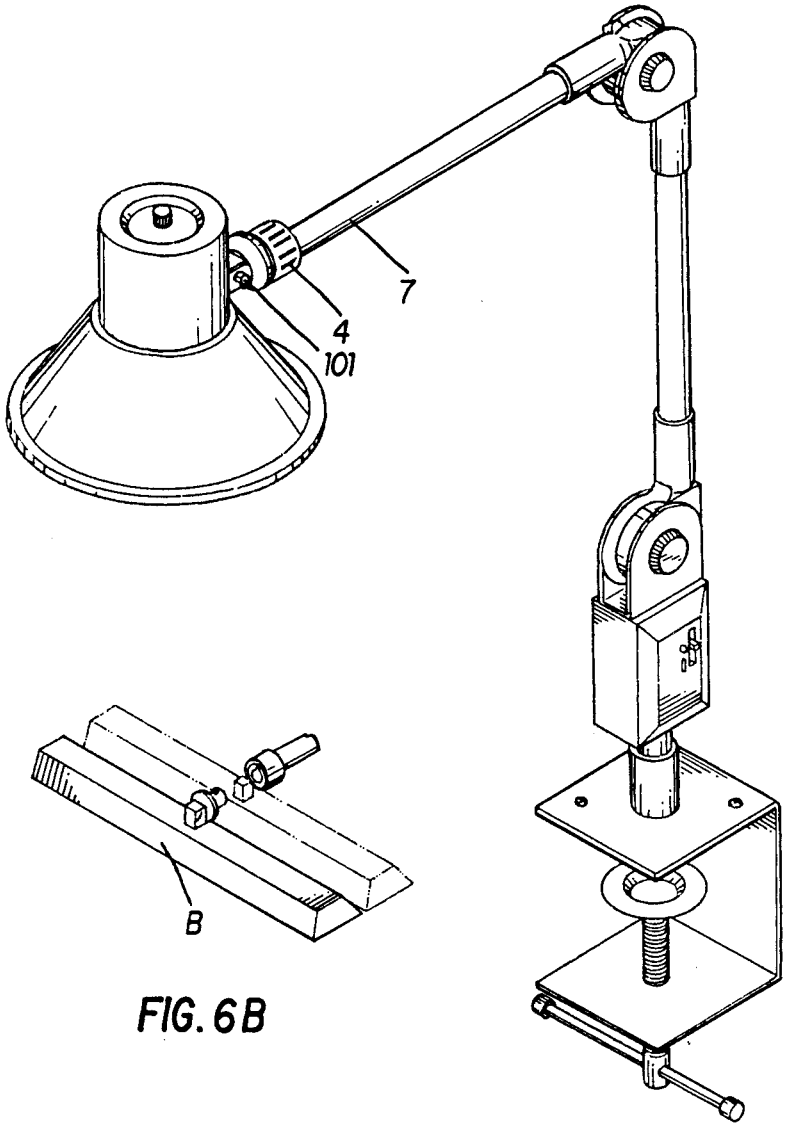

Through use of the elements as hereinbefore described, a modified lamp holder structure may be assembled. Referring in particular to FIGS. 1, 5 and 6, by means of the arrangement of inner thread 41 and guide slot 31, lamp adapter system becomes rotatable. The internal arrangement of the lamp holder structure allows the lamp holder structure to become practical for alternative application in either fluorescent lamp tube types or lamp bulb type table lamps.

Contact plug 21 of selector switch mechanism 2 includes two contact noses 211. Contact noses 211 are located one on the left side and the other at the right side to align and match with two contact noses **223*a* and 223*b* of conduction member 22**.

When stub member 121 on the circular surface of rear end 12 of lamp holder tubular housing 1 is aimed at the guide slot 31 of sleeve member 3 and guided to move ahead by means of inner thread 41 of spiral coupling member 4, two contact noses 211 of contact type plug member 21 of selector switch mechanism 2 are automatically driven to contact with two contact noses **223*a* and 223*b* of conduction member 22**. Thus, no special care is required to prevent an error contact of the fluorescent tube with a lamp bulb plug.

Figure 3:
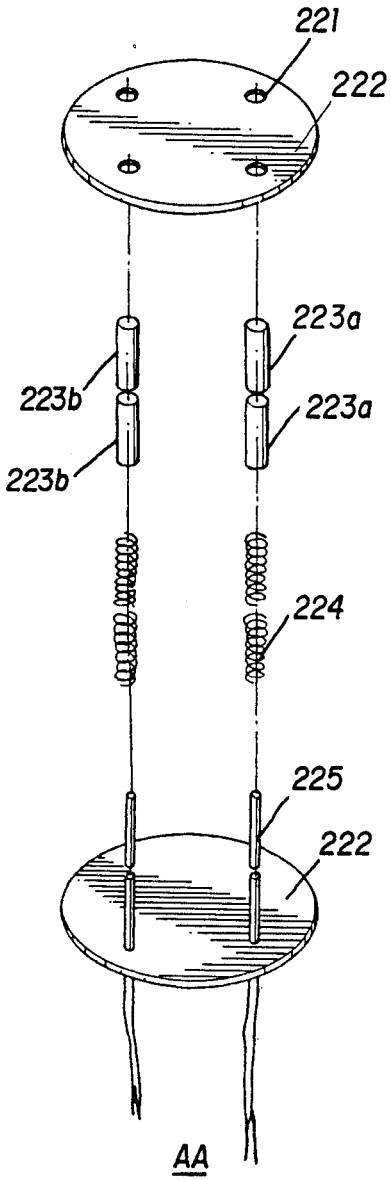
FIG. 3 is a perspective exploded view of the selector switch mechanism.

Referring to FIG. 3, conduction member 22 of selector switch mechanism 2 includes a front end surface 222 which comprises four recess holes 221 and a rear end surface 222' which comprises four mandrels 225 at the front for mounting thereon of four springs 224, respectively, wherein two pairs of terminals **223*a* and 223*b* are respectively mounted on the springs 224 with respective power cords protruding beyond the back side of rear end surface 222'**.

By the mounting arrangement of springs 224 to align and match with mandrels 225 and recess holes 221 of front end surface 222, terminals **223*a* and 223*b* are resiliently disposed. Terminals 223** are divided into two groups, one group for power connection with the fluorescent lamp tube, while the other for power connection with an incandescent lamp bulb.

By means of the above arrangement, the lamp holder structure is practical for use in fluorescent lamp tube table lamps, as well as incandescent lamp bulb type table lamps.

Because the position of the two contact noses 211 of contact type plug member 21 of selector switch mechanism 2 varies with lamp holders, i.e., the two contact noses 211 of fluorescent lamp tube holder are arranged at one side with the two contact noses of the lamp bulb type lamp holder arranged at the other side, and the two contact noses 211 are to selectively match with the two sets of terminals **223*a* and 223*b*. One set of terminals is for a fluorescent lamp tube and the other for an incandescent lamp bulb and mounted at the front end surface 222 of conduction member 22**.

Terminals 223 of conduction member 22 which are for a power connection with the fluorescent lamp tube are arranged to contact with two fluorescent lamp tube contact noses 211 of contact type plug member 21 while the other sets of terminals are provided to connect with the two contact noses for incandescent lamp bulb type table lamps.

With the above structure, any error selection of three-step switch 5 will not allow the power to be connected because it's two contact noses 211 are not in contact with the terminals for the lamp bulb. In the present structure, three step switch 5 is for selection of power-off, fluorescent lamp tube actuation, or incandescent lamp bulb actuation.

Further, contact type plug member 21 and front and rear end surfaces 222 and 222' of conduction member 2 are formed of an electrically insulated material.

Figure 4:
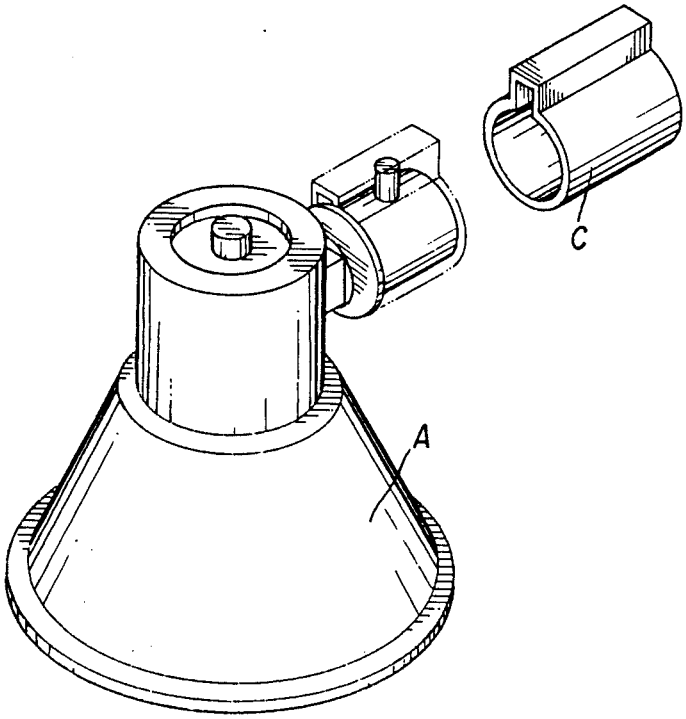
FIG. 4 is a schematic drawing of a lamp shade constructed according to the present invention.

As above described, selector switch 2 is applicable for both fluorescent lamps, as well as incandescent lamp bulb table lamps. Washer 8 may be mounted on the connecting portion between sleeve member 3 and lamp holder 1 to smooth the connection and rotation of stub 121 within sleeve 3. When the lamp holder is detached from the support arm, as shown in FIG. 4, a protective cover C may be provided to protect the contact type plug 21 for storage of the overall system.

What is claimed is:

1. A table lamp adapter system for providing interchangeability between incandescent and fluorescent light bulbs, comprising:

(a) a lamp holder tubular housing having a front section coupled to said light bulb and a rear section having a stub member protruding therefrom;

(b) selector switch means for switching reversibly from incandescent to fluorescent light bulb power actuation, said selector switch means including a contact plug member received within said lamp holder tubular housing;

(c) a sleeve member having a guide slot formed therein, said stub member being linearly displaceable within said guide slot;

(d) a spiral coupling having internal threads and rotatable responsive to said linear displacement of said stub within said guide slot, said spiral coupling being mounted on said sleeve member on a frontal portion thereof in a manner such that through alignment of said internal threads with said guide slot, said stub member is displaced within said guide slot;

(e) a support arm member fixedly coupled to a rear portion of said sleeve member, said selector switch means further including a conduction member having four terminals arranged in two sets, said conduction member being mounted in said sleeve member, said conduction member further including a front end surface member having four recess holes and a rear end surface member which includes four mandrels for mounting thereon of four springs respectively wherein two pairs of terminals are respectively mounted on said springs, said springs in alignment with said mandrels and recess holes of said front end surface member, said terminals being resiliently mounted whereby a pair of contact noses of said contact type plug may be selectively in contact with said pairs of said terminals of said conduction member.

2. The table lamp adapter system as recited in claim 1 including a washer mounted between said sleeve member and said lamp holder tubular housing to smooth connection between said stub member and said sleeve member.

* * * * *